US008142109B2

(12) United States Patent
Schmidt

(10) Patent No.: US 8,142,109 B2
(45) Date of Patent: Mar. 27, 2012

(54) CORROSION-PROTECTED, SELF-DRILLING ANCHOR AND ANCHOR SUBUNIT AND METHOD FOR THE PRODUCTION THEREOF

(75) Inventor: Frank Schmidt, Munich (DE)

(73) Assignee: DYWIDAG-Systems International GmbH, Munich (DE)

( * ) Notice: Subject to any disclaimer, the term of this patent is extended or adjusted under 35 U.S.C. 154(b) by 0 days.

(21) Appl. No.: 12/886,274

(22) Filed: Sep. 20, 2010

(65) Prior Publication Data

US 2011/0070034 A1 Mar. 24, 2011

Related U.S. Application Data

(63) Continuation of application No. PCT/EP2009/001994, filed on Mar. 18, 2009.

(30) Foreign Application Priority Data

Mar. 18, 2008 (DE) ..... 10 2008 014 700

(51) Int. Cl.
*E21D 20/02* (2006.01)

(52) U.S. Cl. ..... 405/259.5; 405/259.1; 411/82.1

(58) Field of Classification Search ..... 405/259.1, 405/259.3, 259.5, 288, 302.1; 411/82, 82.1
See application file for complete search history.

(56) References Cited

U.S. PATENT DOCUMENTS 4,112,637 A * 9/1978 Herbst ..... 405/259.1
4,295,761 A * 10/1981 Hansen ..... 405/259.1
4,630,971 A * 12/1986 Herbst et al. ..... 405/259.5
4,664,555 A * 5/1987 Herbst ..... 405/259.5
4,946,314 A * 8/1990 Gruber ..... 405/259.1
(Continued)

FOREIGN PATENT DOCUMENTS

CH 693 934 A5 4/2004
(Continued)

*Primary Examiner* — Frederick L Lagman
(74) *Attorney, Agent, or Firm* — Muncy, Geissler, Olds & Lowe, PLLC

(57) ABSTRACT

A corrosion-protected, self-drilling anchor and an anchor subunit and to a method for the production thereof is provided. A self-drilling anchor of the invention includes a number of anchor subunits, each with a hollow bar element, which are connected together by the formation of an axial bell butt joint to form a connected pull and pressure member. The first subunit t its end has a drill bit and the subunit is connected non-rotatably with its end to a drilling and injection device. It is provided according to the invention that each hollow bar element is surrounded by a sheathing except for its end sections and the annular gap between the sheathing and hollow bar element is grouted with a first corrosion protection compound. A coupler in the area of the bell butt joint fits tightly against the sheathings of the two hollow bar elements which are part of the bell butt joint. The hollow space between the coupler and hollow bar elements is filled with a second corrosion protection compound. A method of the invention provides for the prefabrication of a number of anchor subunits at the factory to drill these into the substrate at the site of the anchor to be produced and thereby for connecting them together with the formation of bell butt joints, whereby in the area of the bell butt joint a coupler fits tightly against the ends of two neighboring sheathings and the hollow space between the coupler and hollow bar element is filled with a second corrosion protection compound.

14 Claims, 3 Drawing Sheets

U.S. PATENT DOCUMENTS

| | | | | | |
|---|---|---|---|---|---|
| 5,067,854 | A | * | 11/1991 | Sweeney | 405/259.1 |
| 5,433,558 | A | * | 7/1995 | Gray | 405/259.1 |
| 5,636,945 | A | * | 6/1997 | Nes | 405/259.1 |
| 5,653,557 | A | * | 8/1997 | Gruber | 405/259.5 |
| 5,775,849 | A | * | 7/1998 | Sorkin | 405/259.1 |
| 5,791,823 | A | * | 8/1998 | Blakley et al. | 405/259.1 |
| 6,817,810 | B2 | * | 11/2004 | Jones | 405/252.1 |
| 7,465,128 | B2 | * | 12/2008 | Bruneau | 405/259.1 |
| 7,497,053 | B2 | * | 3/2009 | Nicolet | 405/259.1 |
| 7,896,580 | B2 | * | 3/2011 | Weaver et al. | 405/259.1 |

FOREIGN PATENT DOCUMENTS

| | | | | |
|---|---|---|---|---|
| DE | 4204533 | A1 | * | 8/1993 |
| DE | 42 11 334 | C1 | | 9/1993 |
| DE | 195 12 122 | A1 | | 10/1996 |
| EP | 355379 | A2 | * | 2/1990 |
| EP | 445377 | A1 | * | 9/1991 |
| EP | 585537 | A1 | * | 3/1994 |
| JP | 05093500 | A | * | 4/1993 |
| JP | 05263577 | A | * | 10/1993 |
| JP | 05272135 | A | * | 10/1993 |

* cited by examiner

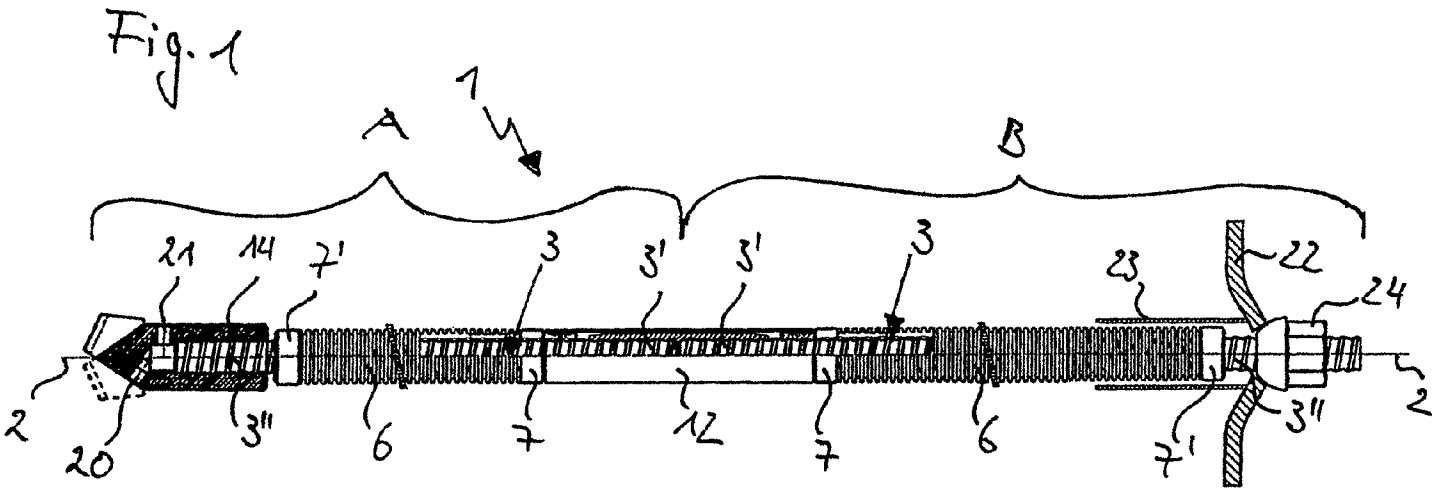
Fig. 1
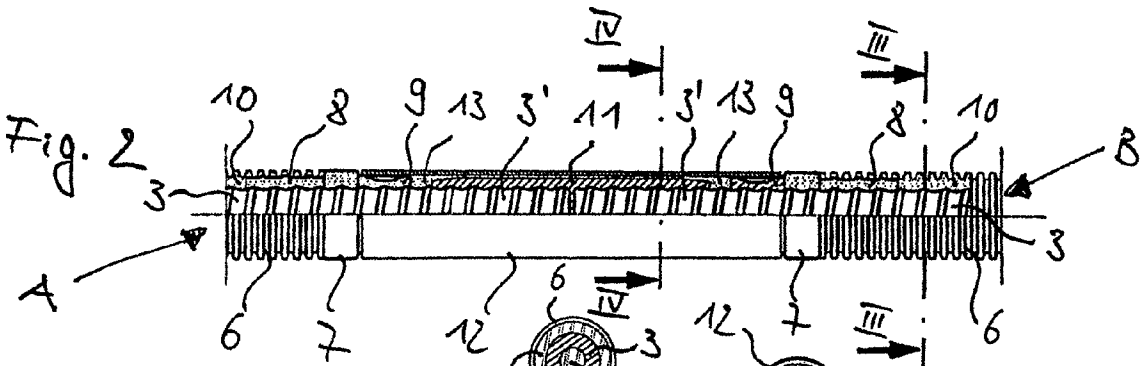
Fig. 2
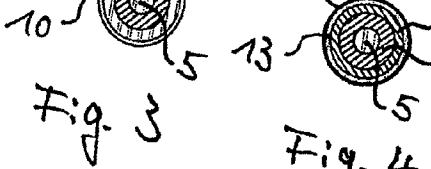
Fig. 3
Fig. 4

CORROSION-PROTECTED, SELF-DRILLING ANCHOR AND ANCHOR SUBUNIT AND METHOD FOR THE PRODUCTION THEREOF

This nonprovisional application is a continuation of International Application No. PCT/EP2009/001994, which was filed on Mar. 18, 2009, and which claims priority to German Patent Application No. DE 10 2008 014 700.1, which was filed in Germany on Mar. 18, 2008, and which are both herein incorporated by reference.

BACKGROUND OF THE INVENTION

1. Field of the Invention

The invention relates to a corrosion-protected, self-drilling anchor, a method for the production thereof, and a prefabricated anchor subunit.

2. Description of the Background Art

Ground and rock anchors and piles are used in underground construction whenever it is necessary to transmit forces in the region of the anchor or pile head to deeper soil strata. This applies equally to tension-loaded anchors and nails and to pressure- or tension-loaded piles. For this purpose, anchors, nails, or piles have a supporting member that is brought into a force-fit connection with the surrounding substrate in a borehole and is anchored on the air-side end in the area of the head. Because the supporting members are usually made of steel, they are susceptible to corrosion.

In this context, a distinction is drawn between supporting members for temporary use and supporting members for permanent use, whereby the latter use requires a structural design suitable for protection from corrosion. The terms double or increased corrosion protection are used when passivation of the steel surface of the supporting member is assured by injection of cement grout and an additional plastic tube, surrounding the anchor, represents a diffusion barrier for liquids.

A special case of anchors is the self-drilling anchor whose fields of application are primarily the production of soil nails, micropiles, and temporary anchors. Self-drilling anchors have substantially a number of anchor bolts with a continuous axial hollow space. A drill bit with cleaning nozzles, which are connected via the continuous axial hollow space to a drilling and injection device on the air-side anchor end, is arranged at the end of the first anchor bolt. The self-drilling anchor after the drilling in of a specific anchor bolt is lengthened by the formation of a bell butt joint. If a self-drilling anchor has reached its predefined length, the formed borehole is injected with cement grout via the axial hollow space and, if necessary, the anchor is tensioned after hardening of the grout material.

The advantages of an anchor of this type are first the rapid construction progress achieved by the boring and moving of the anchor and the injection of the borehole in one operation. Therefore, no separate anchor installation and no pipe and rod construction are necessary. The structural design of a self-drilling anchor and the production process determined thereby, however, do not allow the realization of increased corrosion protection necessary for a permanently protected supporting member.

SUMMARY OF THE INVENTION

On this background, the object of the invention is to develop further prior-art self-drilling anchors to enhance them for permanent use also in a corrosion-susceptible environment. A further object of the invention is to provide a method and prefabricated anchor subunits for the production of an anchor of this type.

Prior to the invention, it was regarded impossible among experts to provide self-drilling anchors with double corrosion protection. On the one hand, there were concerns that the factory preinjected and already hardened corrosion protection compound, usually a cement- or resin-bound grout or suspension, would form cracks between the sheathing and anchor bar during the drilling process and the corrosion protection would be damaged thereby; on the other hand, there was no satisfactory solution to assure corrosion protection also in the joint area of two hollow bars. Use in an environment with a high corrosion risk therefore continued to be denied to the self-drilling anchor.

Thanks to the invention, this bias has been overcome and a self-drilling anchor has been provided that also meets the requirements of increased corrosion protection. For this purpose, the invention provides a solution that assures corrosion protection both in the area of the hollow bars and in the joint area. This is achieved by an axial continuous combination of sheathings and couplers, which represent a first barrier against external, corrosion-causing substances. The hollow space formed thereby to the hollow bar element is filled in each case with a corrosion protection compound, which forms the second barrier against corrosion, which is why the term double corrosion protection is used. An anchor of the invention therefore combines for the first time the advantages of a self-drilling anchor with the advantages of a double corrosion-protected anchor or pile.

In the area of the sheathing, the hollow space is filled by a first corrosion protection compound, which has a hardenable material, for example, of a grout or a suspension with a cement or synthetic resin base. In the area of the coupler, therefore in the joint area, the hollow space filling includes a second corrosion protection compound, which differs in its type from the first corrosion protection compound and includes, for example, a plastically deformable material such as grease and the like.

According to an embodiment of the invention, in each case, an adapter is provided at the end of the sheathing, which even during the manufacturing of the prefabricated anchor subunits seals the openings on the face side of the sheathings tightly against the hollow bar and simultaneously enables tight attachment of the coupler. For this purpose, the adapter preferably has a cylindrical seat, onto which the coupler can be pushed axially, whereby in the insertion area means for securing the position and sealing of the coupler can be arranged, for example, in the form of a circumferential bead. In order not too increase the outside diameter of the self-drilling anchor in this regard, it is advantageous to provide a radial recess in the area of the cylindrical seat for receiving the coupler.

The sheathing and the adapter thus form a tightly sealed hollow space surrounding the hollow bar, as a result of which it is possible to prefabricate anchor subunits serially by factory preinjection of this hollow space with a hardenable corrosion protection compound. The scope of the invention also includes a production method for the anchor subunits, however, in which, instead of adapters which function like a lost formwork, the faces of the hollow space are closed only temporarily for the injection process and until the hardening of the suspension.

The factory production of these anchor subunits offers the great advantage that they can be produced under invariable optimal conditions and independent of climate effects. Thereby, a constant high quality of the thus produced anchor subunits is possible with a corresponding quality gain in the finished self-drilling anchor. Moreover, the corrosion protection compound within the sheathing can be matched, without consideration of the later grouting of the borehole, specifically to the requirements of optimal corrosion protection, for example, by its special composition and the manner of its introduction. For the grouting of the borehole after the anchor has been installed, a cement grout can then be used, likewise optimized for this intended application.

Another embodiment of the invention, moreover, has a drill bit with a nozzle with outlet openings slantingly facing forward in the drilling direction. The jet stream emerging from the nozzle breaks up the substrate in front of the nozzle and can even loosen and pulverize it with use of high pressures. The arrangement of a nozzle with radial outlet openings can be provided alternatively or cumulatively for the same purpose. This produces the advantage that the broken up substrate can be loosened more easily for the drill bit, so that a largely vibration-free advance is possible. Thereby, the risk of crack formation in the area of the preinjected corrosion protection of the hollow bar anchor is minimized.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein:

FIG. 1 shows a side view of a self-drilling anchor of the invention, opened up in part;

FIG. 2 shows a partial view of the self-drilling anchor shown in FIG. 1 in the area of the bell butt joint on a larger scale, opened up in part;

FIG. 3 shows a cross section through subunit B shown in FIG. 1 along the line III-III there;

FIG. 4 shows a cross section through subunit B shown in FIG. 1 along the line IV-IV there;

DETAILED DESCRIPTION

Figure 6:
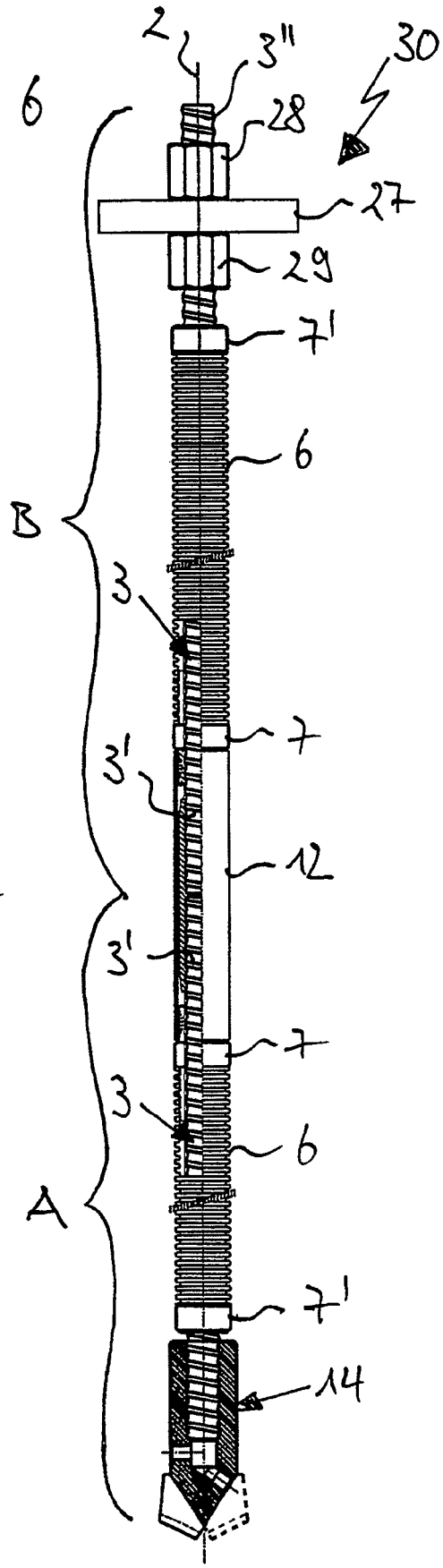
FIG. 6 shows a side view of a self-drilling anchor of the invention as a pile, opened up in part.

A self-drilling anchor 1 of the invention is shown in a general view in FIG. 1, as it can be used advantageously in injectable soils. Anchor 1 in the present example has two factory-prefabricated subunits A and B with substantially the same structure, which are butted form-fittingly along the longitudinal anchor axis 2. The length of units A and B can be varied between 1 m and 6 m as required. An anchor 1 of the invention with the desired total length can be produced by stringing together of a predefined number of subunits A, B each with a predefined length.

The structure of subunits A, B is evident, moreover, from FIGS. 2, 3, and 4. Evident is a hollow bar element 3, which is provided with an outside thread 4 over its entire length and which has an axial through-hole 5 in the area of its longitudinal axis 2. Hollow bar element 3 is surrounded over its entire length, except for its end sections 3', 3", by corrugated sheathing 6 at a clearance distance. The two ends of corrugated sheathing 6 are connected by means of adapter 7 tightly to hollow bar 3. For this purpose, adapter 7 has a connecting piece 8, onto which sheathing 6 is pushed axially, and in the direction of the one end section 3', a cylindrical seat 9, whose lateral area has a circumferential bead. The hollow space, resulting in this manner and closed on all sides, between sheathing 6 and hollow bar element 3 is filled at the factory completely with a first corrosion protection compound 10, for example, with a hardenable injection grout.

In this way, the diffusion-tight material properties of sheathing 6 together with the properties of injection grout 10, achieving the passivation of the steel surface, result in double corrosion protection.

Anchors 1 of any length can be produced by force-fitting axial joining together of a plurality of subunits A, B, prefabricated in such a way. For the joining together, a bell butt joint is provided whose structural design to achieve corrosion protection is evident above all from FIG. 2. The free end sections 3' of two axially opposite hollow bar elements 3 are seen here, which are connected together pull- and pressure-resistant by means of a threaded sleeve 8.

The joint area is moreover surrounded over the entire length of end section 3' by a coupler 12, which with its ends with maintenance of slight axial play fits tightly against cylindrical seat 9 of adapter 7. The hollow space between coupler 12 and end sections 3' of hollow bars 3 or threaded sleeve 11 is filled with a second corrosion protection compound 13, for example, with a grease.

Thus, in the joint area as well, double corrosion protection is present, which is formed, on the one hand, by the diffusion-tight coupler 12 and, on the other, by corrosion protection compound 13. Over the length of an anchor of the invention, thereby an alternating sequence of longitudinal sections results, in which, in one respect, sheathing 6, preinjected with the first corrosion protection compound 10, provides corrosion protection and, in another respect, coupler 12 filled with second corrosion protection compound 13.

Subunit A forms the beginning of an anchor 1 of the invention, whereby end section 3", associated with the borehole bottom, is intended not to form a bell butt joint but to receive a drill bit 14. For this reason, adapter 7' modified at end 3" has no cylindrical seat 9.

Figure 5:
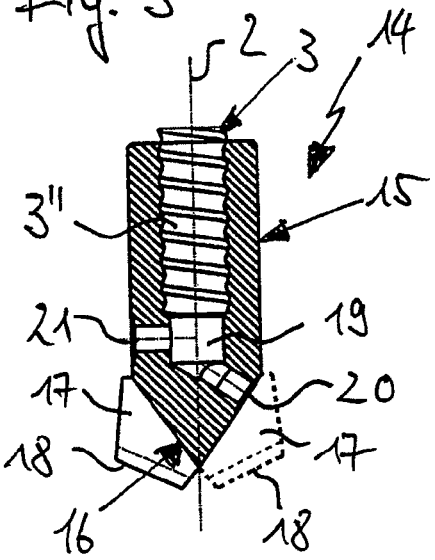
FIG. 5 shows a longitudinal section through the self-drilling anchor shown in FIG. 1 in the area of the drill bit.

The structure of drill bit 14 is evident from FIG. 5, according to which it has a cylindrical body 15, to which on one side a cone tip 16 is connected. Blades 17 with edges 18 to loosen and convey the substrate extend from the lateral surface of cone tip 16 in the radial direction. From the other side of cylindrical body 15 as far as the transition region between cylindrical body 15 and cone tip 16, a blind hole 19 with an inside thread, into which hollow bar element 3 of subunit A is screwed with its end 3", extends in the longitudinal axis 2.

Drill bit 14 has a first injection nozzle 20, which extends from a drilled hole perpendicular to the cone lateral surface to blind hole 19, and a second nozzle 21, which is formed by a drilled hole perpendicular to the cylinder lateral surface of body 15, therefore radially. In this way, together with hollow space 5 of the individual hollow bar elements 3, a continuous hollow space results over the entire length of anchor 1 to nozzles 20 and 21.

Subunit B forms the air-side end of anchor 1, so that here as well its free end 3" of hollow bar 3 serves not to form a bell butt joint but to form the air-side anchorage.

For this purpose, an anchor plate 22, which is intended as support against substrate 25, is put on end section 3". A sealing tube 23 is connected fixedly to the bottom side of anchor plate 22 and surrounds corrugated sheathing 6 at a radial distance. Finally, a dome nut 24, which with its ball-shaped circumferential surface is supported on anchor plate 22 and thus enables tensioning of anchor 1, is screwed on end section 3". To complete the double corrosion protection, here as well the hollow space between sealing sheath 23 and end section 3" of hollow bar element 3 is injected with a cement grout.

In the case of anchoring with more than two subunits, additional subunits are inserted between subunits A and B; the structure thereof corresponds substantially to that of subunits A and B, with the difference that the additional subunits have ends on both sides, which correspond to ends 3' of subunits A and B and thereby enable the formation of a bell butt joint on both sides.

The method for the production of an anchor 1 of the invention will be described in greater detail using FIGS. 7*a* to 7*f*.

Figure 7A:
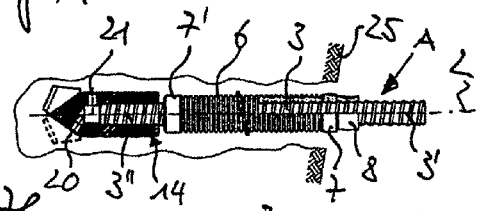
FIGS. 7 *a-f* show the different process steps for the production of an anchor of the invention.

FIG. 7*a* shows the start of the production of an anchor 1 of the invention. For this purpose, a subunit A, comprising a hollow bar element 3 with a drill bit 14 and corrosion protection arranged behind it, including corrugated sheathing 6 and the hardened corrosion protection compound 10 already introduced therein at the factory, is drilled into the substrate with drilling equipment not illustrated further. At the same, drilling air or drilling fluid is transported under high pressure through through-hole 5 to nozzles 20 and 21 at the tip of anchor 1, for breaking up and loosening the substrate. The loosened material is then flushed outward between sheathing 6 and the borehole wall.

Figure 7B:
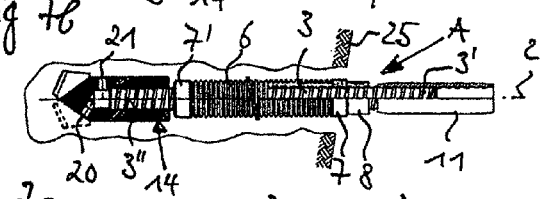

FIG. 7*b* shows a state in which the borehole has reached a depth at which subunit A protrudes from the borehole substantially only still with its end 3'. If this state is achieved, a threaded sleeve 11 is screwed with half of its length onto end 3', so that the other half of threaded sleeve 11 is available for receiving hollow bar 3 of another subunit B.

Figure 7C:
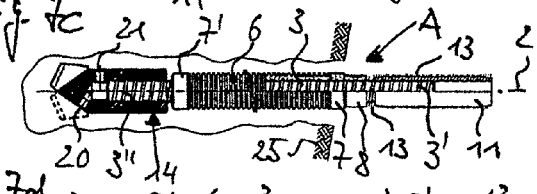

To assure corrosion protection in the joint area, however, a corrosion protection compound 13, for example, in the form of grease, is applied generously beforehand on sleeve 11 and on the exposed area of end 3' of hollow bar element 3, which is shown in FIG. 7*c*.

Figure 7D:
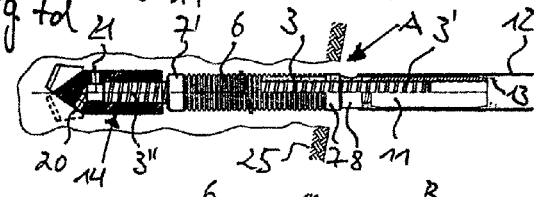

Then, as shown in FIG. 7*d*, coupler 12 is pushed onto threaded sleeve 11, until it sits with its end on the cylindrical seat 9 of adapter 7.

Now, a new subunit, for example, the previously described subunit B, can be screwed into the thus prepared end of subunit A. The additional subunit also has corrosion protection, already produced at the factory, in the area of sheathing 6, as described above. To complete the corrosion protection in the area of the bell butt joint, a corrosion protection compound 13 is also applied beforehand to free end 3' of hollow bar element 3 of subunit B and this is then screwed into threaded sleeve 11. In this regard, coupler 12 with its free edge pushes over cylindrical seat 9 of adapter 7 and in this way forms a continuous and tight connection of the corrugated sheathings 6 of the two subunits A and B.

Figure 7E:
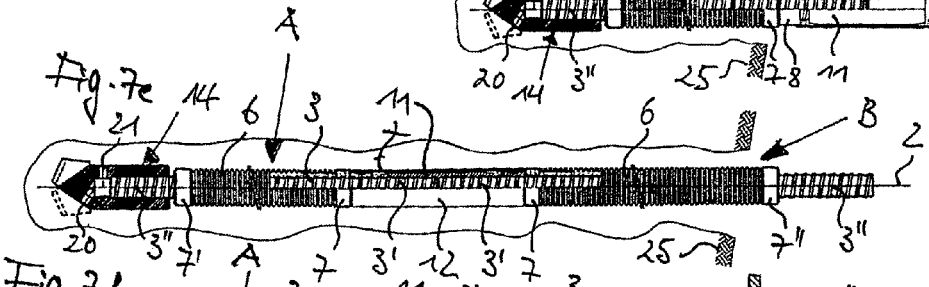
Figure 7F:
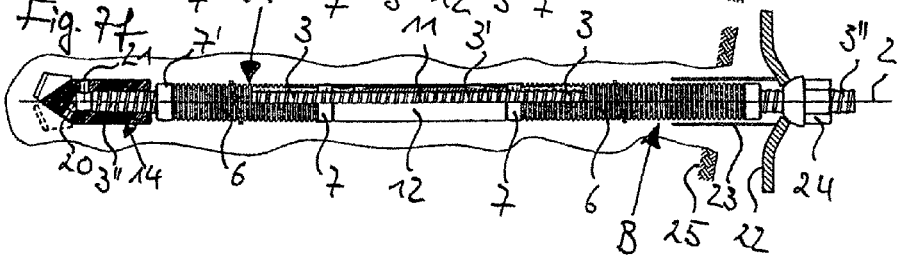

After completion of anchor 1 with subunit B, the borehole can be advanced further, as already described under FIG. 7*a*. This state is shown in FIG. 7*e*.

After the predefined borehole depth is reached, the anchorage is attached at the end of anchor 1. To this end, an anchor plate 22 with sealing tube 23 attached thereto is pushed onto end 3" of hollow bar element 3 of subunit B, until anchor plate 22 lies flat against substrate 25. Then, a dome nut 24 is screwed onto end 3" until it lies with its ball-shaped bottom side against anchor plate 22. The completion of anchor 1 occurs by grouting of the borehole, in other words, of the annular gap between sheathing 6 and the borehole wall with a cement grout and if necessary by tensioning of anchor 1 after the cement grout has hardened.

FIG. 6 shows the use of a self-drilling anchor 26 of the invention as a pile 30. Except for the air-side anchorage of pile 30, pile 30 has an identical structure to anchor 1 described in FIGS. 1 through 5, so that the same reference characters are used for the same features and to avoid repetitions reference is made to the corresponding part of the description.

Because pile 30 is intended to bind with its air-side end into a pile head plate (not shown) made of concrete, an anchor plate 27 is fixed in a predefined position between a nut 28 and a lock nut 29. Because this area is completely surrounded by the concrete of the pile head plate at a later time, a sealing sheathing can be omitted.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A corrosion-protected, self-drilling anchor configured to be arranged within a borehole, comprising:

a plurality of anchor subunits, each having a hollow bar element that are connectable together by an axial bell butt joint to form a connected pull and pressure member, wherein a first subunit has a drill bit and a last subunit is connectable non-rotatably to a drilling and injection device, wherein each hollow bar element is surrounded by a sheathing except for its end sections and an annular gap between the sheathing, and wherein the hollow bar element is grouted with a first corrosion protection compound; and a coupler provided in an area of the bell butt joint that fits tightly against the sheathings of the two hollow bar elements that are part of the bell butt joint, wherein a hollow space between the coupler and hollow bar elements is filled with a second corrosion protection compound.

2. The self-drilling anchor according to claim 1, further comprising an adapter seated on the hollow bar element and to which the coupler is connectable with its ends, the adapter being arranged at each end of the sheathing of a subunit.

3. The self-drilling anchor according to claim 2, wherein the adapter tightly seals the hollow space between the sheathing and hollow bar element at the faces in each case.

4. The self-drilling anchor according to claim 2, wherein the adapter has a cylindrical seat for the coupler.

5. The self-drilling anchor according to claim 2, wherein at least one circumferential bead is arranged in the contact area between the adapter and coupler.

6. The self-drilling anchor according to claim 2, wherein the adapter in the overlap region with the coupler has a radial recess toward a longitudinal anchor axis, which corresponds to the thickness of the coupler.

7. The self-drilling anchor according to claim 1, wherein the drill bit has a nozzle whose outlet opening produces an emerging jet slantingly directed forward.

8. The self-drilling anchor according to claim 1, wherein the drill bit has a nozzle whose outlet opening produces a radial emerging jet.

9. The self-drilling anchor according to claim 1, wherein the hollow space between the sheathing and the borehole wall is grouted with cement grout, which differs in its type from the first corrosion protection compound.

10. A method for the production of a corrosion-protected, self-drilling anchor, the method comprising:

a) preparing a plurality of anchor subunits by placing a sheathing on a hollow bar element and injecting the hollow space between the sheathing and hollow bar element with a first hardenable corrosion protection compound;

b) attaching a drill bit to one end of the first hollow bar element and boring the first subunit into a substrate with simultaneous flushing through the hollow bar element with a fluid until the first subunit is in the borehole over most of its length;

c) creating a bell butt joint between the hollow bar element of a first anchor subunit and the hollow bar element of another prepared second anchor subunit;

d) connecting the sheathings of the two anchor subunits by placing a coupler in an area of the bell butt joint;

e) continuing the boring process with flushing with a fluid, until the second subunit is in the borehole over most of its length;

f) repeating steps c), d), and e) until the self-drilling anchor has achieved its intended length;

g) producing an air-side anchorage; and h) injecting the hollow space between the sheathing and borehole wall with cement grout.

11. The method according to claim 10, wherein step d) is carried out first by connection of a coupler to the air-side end of the sheathing of the first subunit before the creation of the bell butt joint and then by connection the sheathing of the additional subunit to the coupler after the creation of the bell butt joint.

12. The method according to claim 10, wherein the hollow space between the sheathing and hollow bar element in the area of the bell butt joint is filled with a second corrosion protection compound.

13. The method according to claim 10, wherein the substrate during the boring is broken up in the area before and/or to the side of the drill bit.

14. The method according to claim 13, wherein the breaking up of the substrate occurs by jet grouting.

* * * * *